United States Patent [19]

Suzuki et al.

[11] 4,251,060

[45] Feb. 17, 1981

[54] HAND HOIST

[75] Inventors: Noritoshi Suzuki, Zama; Masakatsu Tsubokawa, Yokohama, both of Japan; Roy N. Bathum, Jr., Mercer Island; Ron S. Selset, Bellevue, both of Wash.

[73] Assignees: Kabushiki Kaisha Kito, Kawasaki, Japan; Beebe Brothers, Inc., South Seattle, Wash.

[21] Appl. No.: 932,824

[22] Filed: Aug. 10, 1978

[30] Foreign Application Priority Data

Dec. 20, 1977 [JP] Japan ..... 52-152452
Dec. 21, 1977 [JP] Japan ..... 52-153010

[51] Int. Cl.[3] ..... B66D 1/00
[52] U.S. Cl. ..... 254/356; 192/16; 254/345
[58] Field of Search ..... 254/167, 169, 171, 163, 254/164; 162/16; 64/13 C, 13 E

[56] References Cited

U.S. PATENT DOCUMENTS

| | | | |
|---|---|---|---|
| 1,572,001 | 2/1926 | Dotzert | 254/171 |
| 3,047,114 | 7/1962 | Stevens, Jr. | 254/167 X |
| 3,626,499 | 12/1971 | Iwama | 254/167 |
| 3,776,514 | 12/1973 | Eggleton et al. | 254/167 |

FOREIGN PATENT DOCUMENTS

| | | | |
|---|---|---|---|
| 1195920 | 7/1965 | Fed. Rep. of Germany | 254/167 |
| 1139395 | 2/1957 | France | 254/167 |
| 1094150 | 12/1967 | United Kingdom | 254/167 |

*Primary Examiner*—Billy S. Taylor
*Attorney, Agent, or Firm*—Sughrue, Rothwell, Mion, Zinn and Macpeak

[57] ABSTRACT

A hand hoist comprises a brake support member (1) for supporting brake plates (24, 25) and firmly mounted on a driving shaft (20) detachably connected through gears to a load pulley (32). A brake biasing member (2) is threadedly engaged on the brake support member by means of a ball screw (43–45), and a retainer ring (3) is fixed to an outer surface of the brake biasing member. A friction transmission ring (5) having a frusto-conical friction outer surface (4) is non-rotatably fitted on the retainer ring, and a manually rotated member (6) for rotating the brake biasing member relative to the brake support member includes a frusto-conical inner surface (7) mating with the frictional outer surface of the transmission ring. Belleville springs (9) urge these frusto-conical surfaces against each other, and they are made of different metals, such as steel, bronze or brass. The retainer ring is provided at its end with a plurality of rotation preventing protrusions (47) circumferentially equally spaced apart, side edges of which abut against pins (12,13) planted in holes of the friction transmission ring.

16 Claims, 16 Drawing Figures

HAND HOIST

BACKGROUND OF THE INVENTION

1. Field of the Invention

The present invention relates to a hand hoist for use in raising, lowering or dragging objects to be transferred.

2. Description of the Prior Art

It is well known in the prior art hand hoists to provide a one-way clutch consisting of recesses and rollers for coupling a manual driving lever and a brake biasing member when the lever is driven in a load lowering direction. It is also well known to threadedly engage a brake biasing member onto a brake support member including therebetween friction plates. When a driving lever is manually rotated, the brake biasing member is moved on the brake support member in an axial direction to clamp the friction plates therebetween to obtain a braking action or release the friction plates.

With such known hand hoists, the one-way clutch necessarily complicates the construction of the hoist and enlarges the outer diameter of the rotating member. Moreover, since the material of the friction plates has a relatively low compressive strength, the friction surfaces of the plates must be somewhat wide, so that the hand hoist itself becomes larger. The material of the friction plates is generally low wear resistant which requires their frequent replacement and maintenance.

A clearance for permitting the brake biasing member to move axially often increases due to a tolerance in manufacture or wear. A variation in the clearance greatly affects the angle of the rotation of the driving lever and the brake biasing member. If the clearance becomes larger than a predetermined value, the rotating angle of the driving lever becomes larger correspondingly to lower the operating efficiency of the hand hoist.

SUMMARY OF THE INVENTION

It is an object of the present invention to provide a hand hoist which eliminates the above disadvantages of the prior art.

It is another object of the present invention to provide an improved hand hoist adapted to rotate a brake biasing member and hence an operating lever with a slight torque or moment with the aid of a ball screw.

It is further object of the present invention to provide an improved hand hoist wherein a friction transmission ring and a manually rotating lever can be frictionally coupled in a remarkably rigid manner by a wedge action of frusto-conical surfaces even if urging means or Belleville springs have a small spring constant.

It is an object of the present invention to provide an improved hand hoist which can dispense with opposed friction plates on both sides of a manual rotating lever and a one-way clutch, resulting in less parts to make the hoist simple in construction, light weight and small in size.

It is further object of the present invention to provide a hand hoist which can prevent the lowering of the maneuverability resulting from the excess idling angle of the operating lever due to tolerances of parts in manufacture.

In order that the invention may be more clearly understood, preferred embodiments will now be described by way of example, with reference to the accompanying drawings.

BRIEF DESCRIPTION OF THE DRAWINGS

In the drawings, which illustrate the exemplary embodiments of the invention.

DETAILED DESCRIPTION OF THE PREFERRED EMBODIMENT

Figure 1:
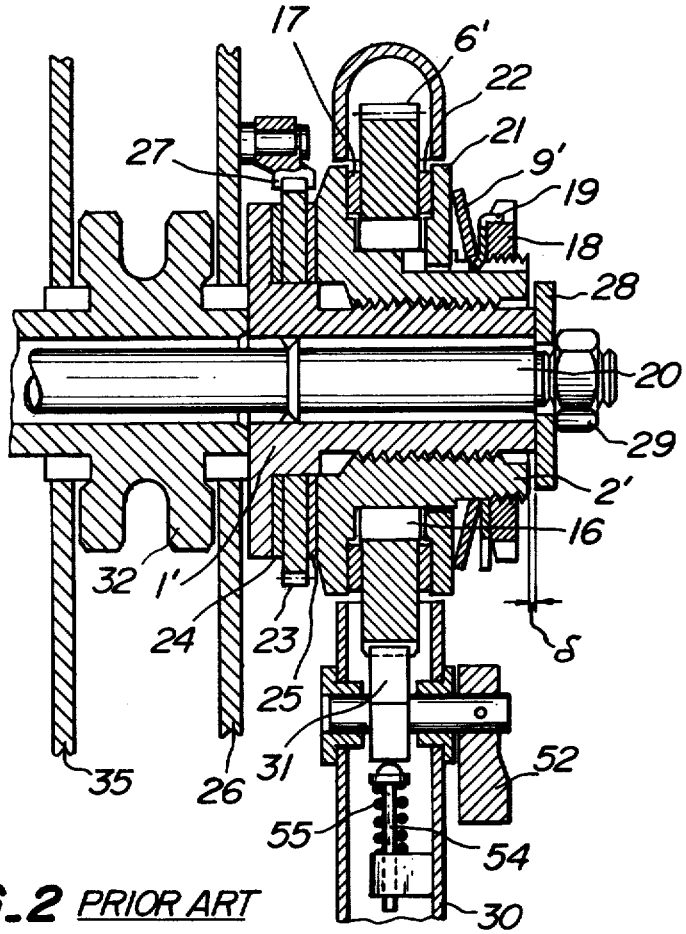
FIG. 1 PRIOR ART
FIG. 1 is a sectional view of an exemplary hand hoist of the prior art.
Figure 2:
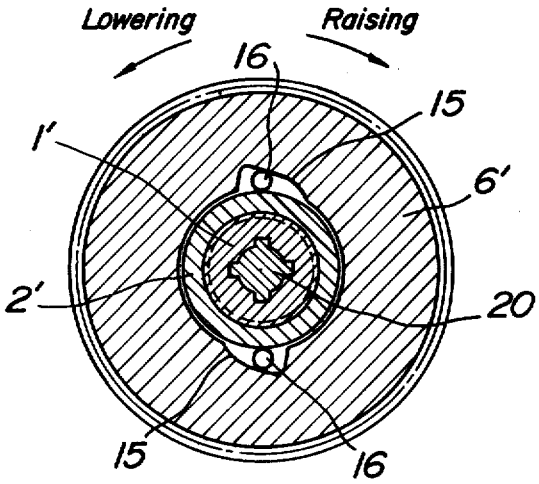
FIG. 2 PRIOR ART
FIG. 2 is a partial sectional view of the hoist shown in FIG. 1 showing an one-way clutch in the hoist.

As shown in FIGS. 1 and 2, the prior art teaches a brake support member 1' fitted on a driving shaft 20 so as not to be rotated relative thereto, a brake biasing member 2' threadedly engaged on the brake support member 1' manual rotating member 6' having a change-over ratchet wheel fitted on the brake biasing member 2' and rollers 16 received within recesses 15 formed in the inside of the rotating member 6' to form a one-way clutch with the recesses for coupling the rotating member 6' and the brake biasing member 2' when the rotating member 6' is rotated in an unloading direction. Such a one-way clutch makes it possible for the hoist to unload even if under an overload condition and to facilitate the unloading of objects without any trouble. A friction plate 17 is interposed between one side surface of the manual rotating member 6' and the flange of the brake biasing member 2', while between the other side surface of the manual rotating member 6' and an adjusting clamp member 18 threadedly engaged on the member 2' are interposed a lock washer 19, a Belleville spring 9', a retainer plate 21 nonrotatable relative to the brake biasing member 2' and a friction plate 22 in succession. Between a flange provided on the inner end of the brake support member 1' and the inner end of the brake biasing member 2' are interposed a ratchet wheel 23 and friction plates 24 and 25 on opposite sides thereof. A pawl 27 pivotally secured to a plate member 26 of a frame is brought into engagement with teeth of the ratchet wheel 23 by the resilient force of a spring (not shown). A retainer member 28 is fitted on the end of the driving shaft 20 and clampled against the outer end surface of the brake support member 1' by means of a nut 29 to provide a clearance $\delta$ between the retainer member 28 and the brake biasing member 2'. On the outer surfaces of the brake biasing member 2' and retainer plate 21 is rotatably fitted an operating lever 30 which is provided with a change-over pawl 31 adapted to be engaged with teeth of the manually rotating member 6' for driving it in a normal or reverse direction.

With such a hand hoist, there is provided the one-way clutch between the brake biasing member 2' and the manually rotating member 6' as above described, which necessarily complicates the construction of the hoist and unavoidably enlarges the outer diameter of the rotating member 6'. Moreover, the friction plates 17 and 22 are interposed between the rotating member 6' and the flange of the brake biasing member 2' and the retainer plate 21, respectively. Since the material of the friction plates has a relatively low compressive strength, the friction surfaces of the friction plates must be somewhat enlarged, so that the diameters of the flange of the brake biasing member 2', the retainer plate 21 and the bottom end of the operating lever 30 become larger resulting in a large sized hand hoist. The material of the friction plates has a low wear-resistant property, which requires their frequent replacement and is disadvantageous in maintenance.

When the operating lever 30 is moved in the unloading direction for lowering the hung load, the brake biasing member 2' is rotated and moved towards the retainer member 28 for releasing the braking action. When the operating lever 30 is moved in the loading direction for raising the load, the brake biasing member 2' is rotated and moved away from the retainer member 28 for braking action. The clearance δ between the retainer member 28 and the brake biasing member 2' permits these movements of the brake biasing member 2' towards and away from the retainer member 28. A variation in the clearance δ greatly affects the angle of the rotation of the operating lever 30 and the brake biasing member 2'. If the clearance δ becomes larger than a predetermined value due to a tolerance in manufacture or wear, the rotating angle of the operating lever 30 becomes larger correspondingly which will lower the operating efficiency of the hand hoist.

Referring to FIGS. 3–6 illustrating one embodiment of the present invention, a cylindrical driven member 33 integrally provided with a load sheave or pulley 32 is rotatably journalled in bearings provided in a pair of plates 26 and 35 of a frame 34. A driving shaft 20 is rotatably fitted in the driven member 33 and is provided at its one end with a pinion 36 fixed thereto. Two intermediate shafts 38 are rotatably journalled in the side plate 35 and a gear box 37, to which shafts 38 are respectively fixed large intermediate driven gears 39 simultaneously in mesh with the pinion 36 and small intermediate driving gears 41 simultaneously in mesh with a large driven gear 40 integrally provided in one end of the driven member 33. A compression spring 42 is located about the shaft 20 between the pinion 36 and a shoulder formed in the inside of the driven member 33 to urge the driving shaft 20 such that the pinion 36 on the driving shaft 20 is normally in mesh with the large intermediate driven gears 39.

A brake support member 1 is fitted on the other end of the driving shaft 20 against its rotation relative to the brake support member 1. Spiral grooves 43 and 44 are formed in the outer surface of a cylindrical portion of the brake support member 1 and in the inner surface of the brake biasing member 2 arranged about the brake support member 1 to form a spiral passage for a number of balls 45. The threaded engagement of the brake biasing member 2 with the brake support member 1 is accomplished by the ball screw composed by the balls 45 and the grooves 43 and 44.

Between a flange of the brake support member 1 at its one end and an end surface of the brake biasing member 2 are interposed a ratchet wheel 23 and friction plates 24 and 25 in contact with side surfaces of the wheel 23, respectively. A pawl 27 pivotally secured to the other plate 26 is brought into engagement with teeth of the ratchet wheel 23 by a resilient force of a spring 46 engaging the pawl 27. A retainer ring 3 is fitted on the outside of the brake biasing member 2 so as not to rotate relative thereto. A friction transmission ring 5 having a frusto-conical friction outer surface 4 is threadedly engaged with the outer surface of the retainer ring 3.

A manual rotating member 6 of a change-over ratchet wheel includes a frusto-conical friction inner surface 7, which abuts against the friction surface 4 of the friction transmission ring 5. Between the manual rotating member 6 and a spring support 8 in the form of a flange provided in one end of the retainer ring 3 are interposed Belleville springs 9 under a compressed condition which force the friction surfaces 4 and 7 against each other. The manual rotating member 6 is made of, for example, steel. The friction transmission ring 5 is made of a metal different from that of the rotating member 6, for example, cast iron, phosphor bronze or brass.

The retainer ring 3 is provided at the other end with three rotation preventing protrusions 47A–47C circumferentially equally spaced having side edges 10 and 11 extending in parallel with each other in an axial direction of the ring 3. The friction transmission ring 5 is formed with three holes 48–50 for spring pins. The first spring pin 12 is detachably inserted in the first hole 48 and engages a counterclockwise end 10 of the first protrusion 47A. The second spring pin 13 is detachably inserted in the second hole 49 and engages a clockwise end 11 of the second protrusion 47B. The clockwise or counterclockwise end used herein means in the drawings the lead or tail end of the protrusion if it were rotated in the clockwise direction in the drawings. The retainer ring 3 and the friction transmission ring 5 are bound to each other by means of the spring pins 12 and 13 and the protrusions 47A and 47B to prevent relative movement. The third hole 50 is located in opposition to the mid portion of the third protrusion 47C. Commercially available spring pins are preferably used for the pins 12 and 13, which are resilient in the radial direction and convenient to be fitted in the holes. However, rigid pins to be press fitted may be used for this purpose.

Figure 3:
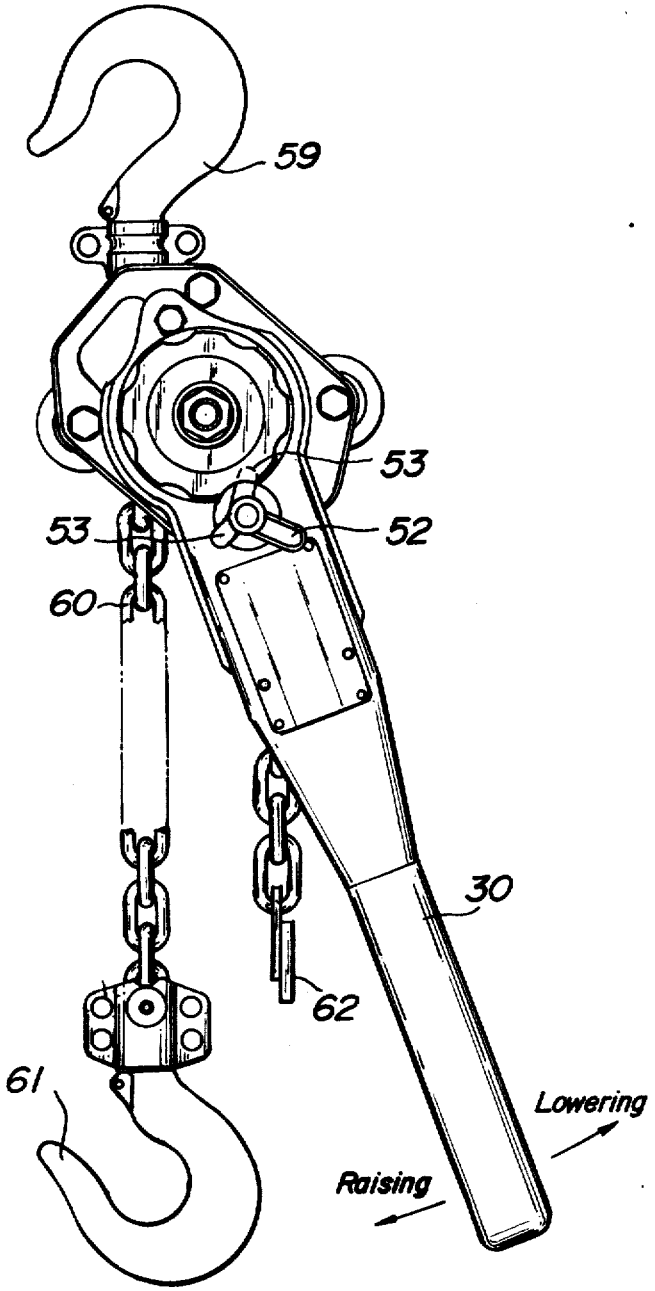
FIG. 3 is a side view of one embodiment of the hand hoist according to the invention.

An operating lever 30 is rotatably fitted at its bottom on an intermediate outer surface of the brake biasing member 2 and a short cylinder portion of the manual rotating member 6. To the bottom of the operating lever 30 is rotatably secured a support shaft 51 to which are fixed a change-over pawl 31 having pawls for normal and reverse rotations and an operating lever 52 for the change-over pawl. The operating lever 52 is formed with a pair of engaging fingers 53 as shown in FIG. 3. The operating lever 30 is provided with a holding piece 54 slidable therein and urged against the change-over pawl by means of a spring 55 for holding the change-over pawl 31 in its neutral position and normal and reverse rotating positions.

The brake support member 1 is formed in the other end with spline grooves for nonrotatably mounting a stopper ring 56. The stopper ring 56 is provided on its outer periphery with a stopper 14 extending into a space between the rotation preventing protrusions 47A and 47B. A knob or handle 58 for sliding the pinion 36 is detachably mounted on the other end of the driving shaft 20.

Figure 4:
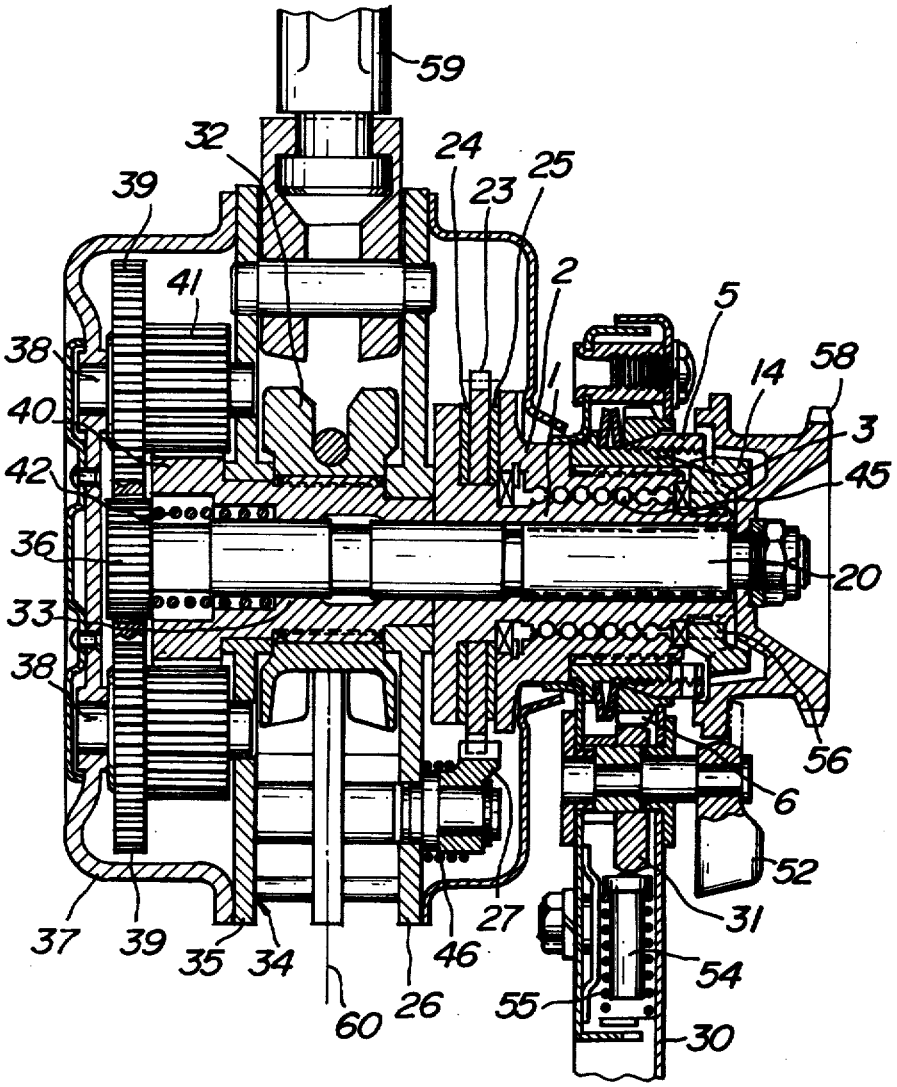
FIG. 4 is a sectional view of the hand hoist shown in FIG. 3.
Figure 5:
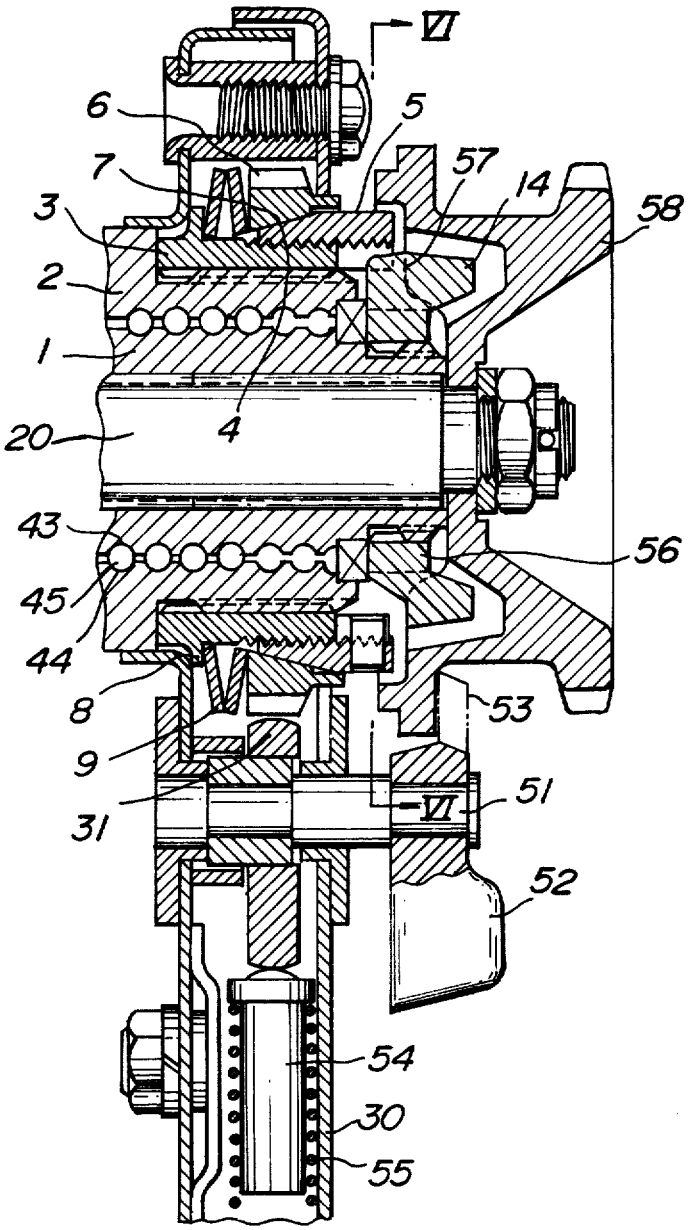
FIG. 5 is an enlarged sectional view of the part of the hoist shown in FIG. 4.
Figure 6:
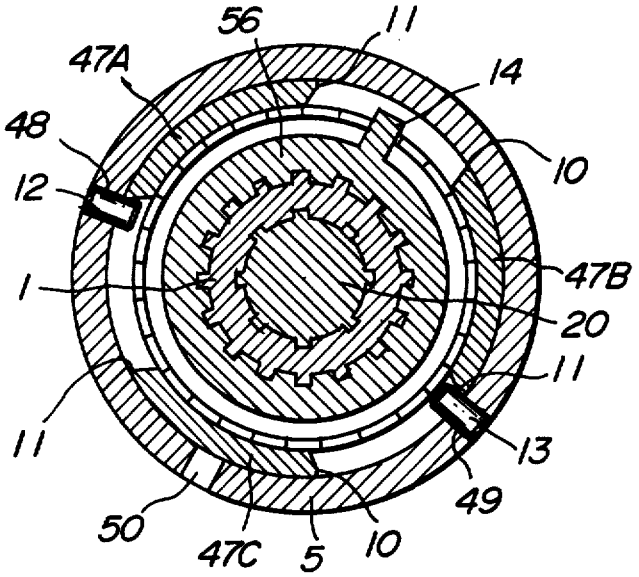
FIG. 6 is a sectional view taken along lines VI—VI in FIG. 5.
Figure 7:
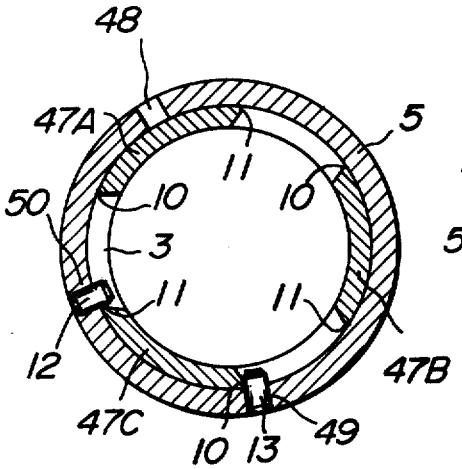
FIGS. 7–14 are sectional views illustrating the retainer ring and friction transmission ring combined in different phases according to the invention.
Figure 8:
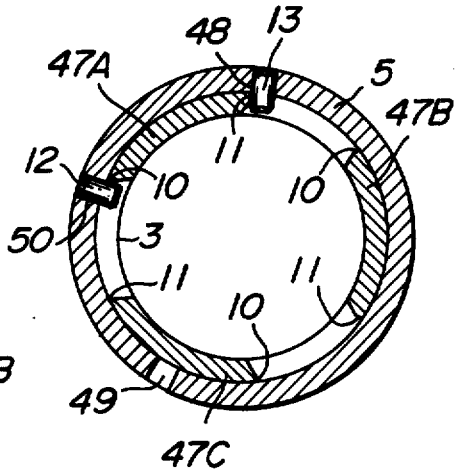
Figure 9:
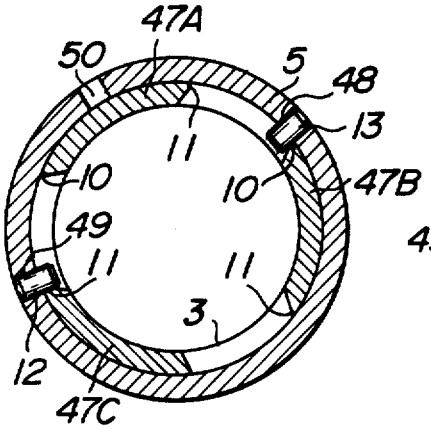
Figure 10:
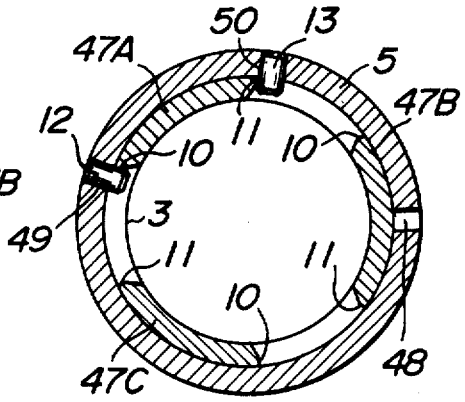
Figure 11:
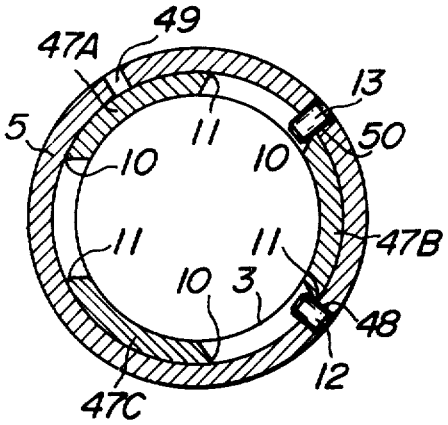
Figure 12:
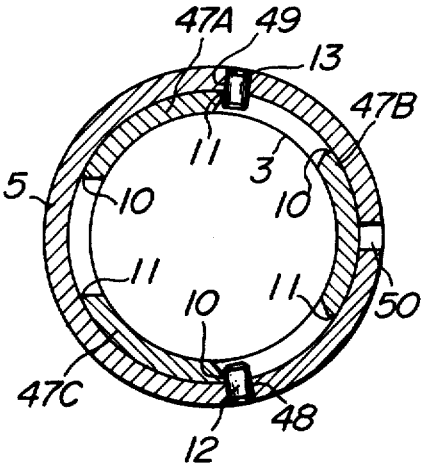
Figure 13:
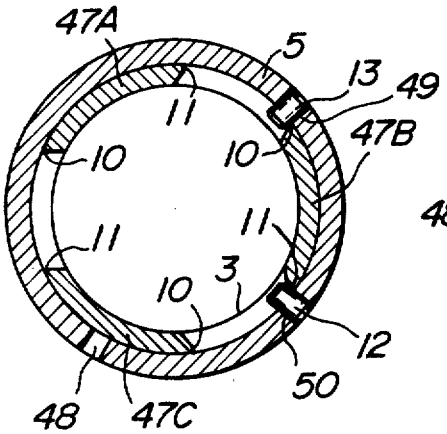
Figure 14:
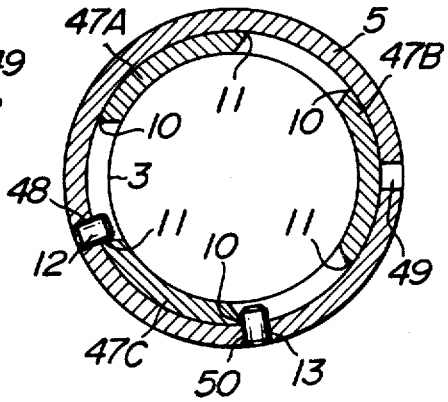

When one of the pawls of the change-over pawl 31 for normal and reverse rotations is engaged with one of teeth of the manually rotating member 6, one of the engaging fingers 53 of the operating lever 52 for the change-over pawl 31 is in opposition to the surface of the knob 58 as shown in phantom lines in FIG. 4 to prevent it from being pulled into an idling position, thereby eliminating a risk of changing the pinion 36 into the idling position by accident when raising or lowering objects.

When the operating lever 52 for the change-over pawl is in the neutral position and the knob 58 is pulled against the force of the spring 42 in the right direction as viewed in FIG. 4, the pinion 36 is disengaged from the intermediate driven gears 39 into its idling position, whereupon the knob 58 is rotated through an angle (for example 90°) so that an end of a cam protrusion 57 of the knob 58 abuts against the outer surface of the stopper 14 thereby maintaining the above described idling condition.

It is understood that the hand hoist of course comprises an upper hook 59 on the upper end of the frame 34 for hanging the hoist, a lower hook 61 at the lower end of a load chain 60 extending about the load pulley 32 for hanging objects or articles to be transferred and a stopper 62 at the other end of the load chain 60.

With the above embodiment, as the brake biasing member 2 is threadedly engaged with the brake support member 1 through the ball screw, the brake biasing member 2 and hence the operating lever 30 can be rotated with a slight torque or moment to improve the manueverability of the hoist. Moreover, as the resistance to the relative rotation between the brake biasing member 2 and the brake support member 1 becomes remarkably small, the brake biasing member 2 can be rotated with ease into the brake releasing direction, in the event of an excess braking action.

In carrying out the present invention, the friction transmission ring 5 and manual rotating member 6 may be made of the same metal, for example, steel, and any one of the frusto-conical outer surface of the friction transmission ring 5 and the frusto-conical inner surface of the manual rotating member 6 may be lined with a different metal, such as phosphor bronze or brass. The manual operating member may be a hand chain pulley manually driven by an endless chain. Furthermore, the present invention can be applied to hoists using link chains or roller chains as load chains, hand hoists including wire ropes extending about load pulleys and any other hand hoists.

According to the present invention, on the brake biasing member 2 is fitted the retainer ring 3 onto which is fitted the friction transmission ring 5 having the frusto-conical friction surface 4 onto which is fitted the frusto-conical friction surface 7 of the manual operating member 6 which surface 7 is forced to the friction surface 4 by the resilient force of the Belleville springs 9. With this arrangement, the friction transmission ring 5 and the member 6 can be frictionally coupled in a remarkably rigid manner with the aid of the wedge action of the frusto-conical surfaces even if the Belleville springs 9 have a relatively small spring constant. The hand hoist according to the invention can dispense with opposed friction plates on both sides of the manual rotating member and the one-way clutch arranged between the manual rotating member and the brake biasing member, resulting in less parts to make the hoist simple in construction, light weight and small in size. As the friction surfaces 4 and 7 are made of different metals, the contact surfaces of the friction transmission ring 5 and the manual rotating member 6 are protected from being jammed due to excess pressure. The friction surfaces 4 and 7 made of the metals are superior in wear-resistance to hitherto used friction plates to improve its durability.

According to the preferred embodiment of the present invention as shown in FIGS. 7–14, positions of the spring pins 12 and 13 selectively inserted in the holes 48–50 and the engaged relations with the protrusions 47A–47C make it possible to couple the retainer ring 3 and the friction transmission ring 5 in nine kinds of different phases so that the screw threaded amount of the ring 5 onto the retainer ring 3 can be finely adjusted and determined.

Figure 15:
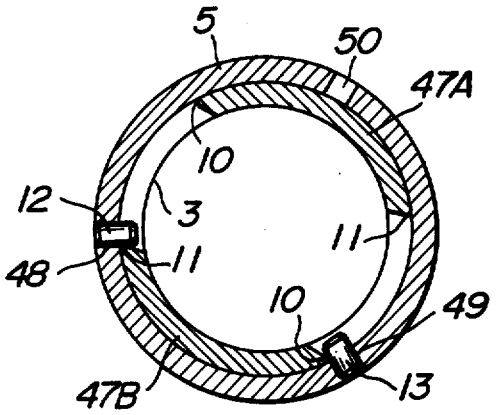
FIG. 15 is a sectional view illustrating the retainer ring and friction transmission ring combined by two rotation preventing protrusions.

FIG. 15 illustrates an embodiment of the invention wherein the retainer ring 3 is provided at its end with two protrusions 47A and 47B and the friction transmission ring 5 is formed with three holes 48–50 for the pins. In this case, the retainer rings 3 and friction transmission ring 5 are coupled in six different phases.

Figure 16:
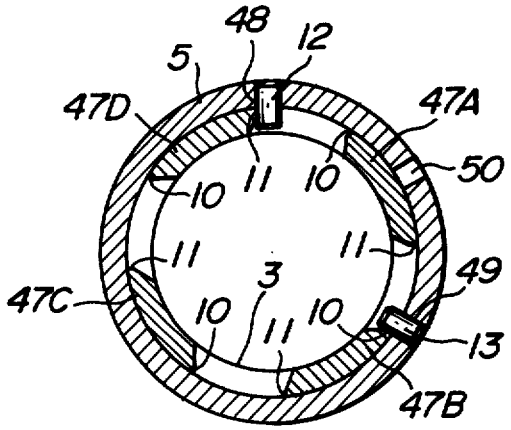
FIG. 16 is a sectional view illustrating the retainer ring and friction transmission ring combined by four rotation preventing protrusions.

Referring to FIG. 16 illustrating another embodiment, the retainer ring 3 is provided on its end with four protrusions 47A–47D for preventing the rotation and the friction transmission ring 5 is formed with three holes 48–50 for the pins. In this case, the retainer ring 3 and the friction transmission ring 5 are coupled in twelve different phases. The third hole 50 may be omitted.

According to the invention, by rotating the friction transmission ring 5 relative to the retainer ring 3 to adjust the compression of the Belleville springs 9, the frictional transmission between the rings 5 and the rotating member 6 can easily be adjusted. As the side edges 10 and 11 of the protrusions formed in the retainer ring 3 extend in parallel with each other in the axis of the retainer ring 3, the retainer ring 3 and the friction transmission ring 5 can be coupled against a relative rotation by means of the spring pins 12 and 13 even if the ring 5 has been axially moved for adjusting the screwed amount of the ring 5 relative to the retainer ring 3. Furthermore, as the stopper 14 fixed to the brake support member 1 is arranged between the adjacent protrusions, the brake biasing member 2 and the parts supported thereby are permitted to move to an extent corresponding to spaces on both sides of the stopper 14, whereby any tolerance of the parts in manufacture does not affect the idling angle. Accordingly, the lowering of the maneuverability resulting from the excess idling angle of the operating lever 30 due to the tolerance of the parts in manufacture can be avoided. Moreover, only one spring pin is arranged between the adjacent rotation preventing protrusions to ensure the required idling angle even if the stopper 14 and spring pin are arranged between the adjacent protrusions.

Although there has been shown and described specific structures, it is to be clearly understood that the same were merely for the purpose of illustration, and that changes and modifications may readily be made therein by those skilled in the art without departing from the spirit and scope of the invention.

What is claimed is:

1. A hand hoist comprising: a driving shaft, a brake support member supporting brake plate means, said brake support member being fixedly mounted on said driving shaft, gear means detachably connecting said driving shaft to a load pulley, a brake biasing member threadedly engaged on said brake support member, a retainer ring fixed to an outer surface of the brake biasing member, a transmission ring having a frusto-conical frictional outer surface, said ring being non-rotatably fitted on said retainer ring, a manually rotated means for rotating said brake biasing member relative to said brake support member and including a frusto-conical frictional inner surface mating with said frusto-conical frictional outer surface of said transmission ring, and Belleville springs for urging said frusto-conical frictional surfaces against each other.

2. A hand hoist as set forth in claim 1, wherein a ball screw is arranged between said brake support member and said brake biasing member for threaded engagement therebetween.

3. A hand hoist as set forth in claim 1, wherein said frusto-conical frictional inner and outer surfaces are made of different metals.

4. A hand hoist as set forth in claim 3, wherein said manually rotated means and said transmission ring are made of the same metal, such as steel, and any one of said frusto-conical frictional inner and outer surfaces is lined with a metal selected from cast iron, phosphor bronze and brass.

5. A hand hoist as set forth in claim 1, wherein said manually rotated means includes a lever.

6. A hand hoist as set forth in claim 1, wherein said retainer ring is provided at one end thereof with a plurality of rotation preventing protrusions circumferentially equally spaced apart, a plurality of pins fitted in a plurality of holes in the transmission ring, said protrusions having side edges abutting against said pins for preventing the retainer ring from rotating relative to the transmission ring.

7. A hand hoist as set forth in claim 6, wherein the relative position between said retainer ring and the transmission ring may be finely adjusted by selections of said holes in the transmission ring for locating said pins and said rotation preventing protrusions to be engaged with said pins.

8. A hand hoist as set forth in claim 6, wherein said pins are spring pins having a radial resilience.

9. A hand hoist as set forth in claim 6, wherein said side edges of said rotation preventing protrusions to be engaged with said pins are parallel to each other in an axial direction of the retainer ring.

10. A hand hoist as set forth in claim 6, wherein one of said pins is engaged with one side edge of a protrusion and another of said pins is engaged with the other side edge of said protrusion.

11. A hand hoist as set forth in claim 6, wherein one of said pins is engaged with one side edge of a protrusion and another of said pins is engaged with one side edge of another protrusion corresponding to the other side edge of the first mentioned protrusion.

12. A hand hoist as set forth in claim 6, wherein there are two pins and three protrusions.

13. A hand hoist as set forth in claim 6, wherein there are two pins and two protrusions.

14. A hand hoist as set forth in claim 6, wherein there are two pins and four protrusions.

15. A hand hoist as set forth in claim 6, wherein said brake suppport member is provided with a stopper extending into a vacant space between said rotation preventing protrusions.

16. A hand hoist as set forth in claim 15, further comprising a knob for disconnecting said driving shaft from the load pulley, said knob having a cam protrusion for maintaining the disconnection of said driving shaft by engagement of said cam protrusion with said stopper.

* * * * *